US006764314B1

(12) United States Patent
Lee

(10) Patent No.: US 6,764,314 B1
(45) Date of Patent: Jul. 20, 2004

(54) MULTIPLE-CONTACT MICRON CONNECTOR

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/668,332

(22) Filed: Sep. 24, 2003

(51) Int. Cl.[7] ..... H01R 12/00
(52) U.S. Cl. ..... 439/65; 439/660
(58) Field of Search ..... 439/65, 660, 74

(56) References Cited

U.S. PATENT DOCUMENTS 5,599,192 A * 2/1997 Olson ..... 439/65
5,915,976 A * 6/1999 McHugh ..... 439/74
6,036,504 A * 3/2000 McHugh et al. ..... 439/74
6,257,900 B1 * 7/2001 Huang et al. ..... 439/74
6,296,524 B1 * 10/2001 Goto ..... 439/660
6,623,308 B2 * 9/2003 Ono ..... 439/680

* cited by examiner

*Primary Examiner*—P. Austin Bradley
*Assistant Examiner*—X. Chung-Trans
(74) *Attorney, Agent, or Firm*—Rosenberg, Klein & Lee

(57) ABSTRACT

A multiple-contact micron connector including a base seat main body and a socket main body inserted in a longitudinal insertion channel of the base seat main body. Two sides of the insertion channel are formed with multiple terminal receptacles. Two sides of the socket main body are formed with multiple terminal receptacles. Multiple first type terminals are respectively inserted in the terminal receptacles of the base seat main body. Each first type terminal has a second leg and a contact pin. Multiple second type terminals are respectively inserted in the terminal receptacles of the socket main body. Each second type terminal has a first leg and a contact section. The second leg resiliently abuts against the first leg to form a first electric contact and the contact pin resiliently contacts with the contact section to form a second electric contact.

8 Claims, 7 Drawing Sheets

MULTIPLE-CONTACT MICRON CONNECTOR

BACKGROUND OF THE INVENTION

1. Field of the Invention

The present invention is related to a multiple-contact micron connector, and more particularly to a micron connector in which the first type terminal resiliently tightly clamps two sides of the second type terminal to form two electric contacts.

2. Description of the Prior Art

FIGS. 1 and 2 show an existent micron connector applied to telecommunication products. The micron connector includes a base seat main body 91, a socket main body 92, first type terminals 93 and second type terminals 94. Two sides of the base seat main body 91 are respectively parallelly formed with multiple terminal receptacles 911. A fixing seat 912 is disposed on outer side of each terminal receptacle 911. An insertion cavity 912*a* is formed in the fixing seat 912. A fixing pin 931 of the first type terminal 93 is correspondingly inserted in the insertion cavity 912*a* of the fixing seat 912. A tail end contact pin 932 of the first type terminal 93 extends into the terminal receptacle 911. The socket main body 92 has two sidewalls 921. The distance H1 between the two sidewalls 921 is equal to or slightly smaller than the distance H2 between inner sides of the fixing seats 912 on two sides of the base seat main body 91. Accordingly, the socket main body 92 can be correspondingly inserted in the base seat main body 91. The inner sides of the two sidewalls 921 of the socket main body 92 are respectively parallelly formed with multiple terminal cavities 922 for firmly inserting the second type terminal 94 therein. When the socket main body 92 is inserted into the base seat main body 91, a rear section 941 of the second type terminal 94 correspondingly resiliently contacts with one side of the tail end contact pin 932 of the first type terminal 93 to electrically connect the first type and second type terminals 93, 94.

The above micron connector has very small volume. The length of such micron connector is about 5~40 mm (varied with the number of accommodated terminals). The width of such micron connector is about 4 mm. The pitch between adjacent terminals is only below about 0.5 mm. Therefore, the tail end contact pin 932 of the first type terminal 93 can be only resiliently micro-biased to lean against outer side of the rear section 941 of the second type terminal 94 to electrically connect the first type and second type terminals 93, 94. The base seat main body 91 and the socket main body 92 are made of plastic material. Due to contraction of the material, in manufacturing, the distance H2 between the fixing seats 912 of the base seat main body 91 or the distance H1 between the two sidewalls 921 of the socket main body 92 is often unequal to the originally designed size. Therefore, it often takes place that the distance is too long and the tail end contact pin 932 of the first type terminal 93 can hardly resiliently tightly lean against outer side of the rear section 941 of the second type terminal 94. This leads to poor contact.

SUMMARY OF THE INVENTION

It is therefore a primary object of the present invention to provide a multiple-contact micron connector including: a base seat main body, a longitudinal insertion channel being formed on upper end face of the base seat main body, a central partitioning board being disposed at a center of the insertion channel, two sides of the partitioning board being respectively parallelly formed with multiple terminal receptacles; a socket main body, two sides of the socket main body being parallelly formed with multiple terminal receptacles, whereby the socket main body can be correspondingly inserted in the insertion channel of the base seat main body; multiple first type terminals respectively inserted in the terminal receptacles of the base seat main body, each first type terminal having a U-shaped section bridged over a support board on outer side of the terminal receptacle, a rear end of a first leg of the U-shaped section being radially bent to form a connecting pin for connecting with a circuit board, a resilient arm extending from a rear end of a second leg of the U-shaped section, a contact pin upward extending from a rear end of the resilient arm; and multiple second type terminals each having a U-shaped section inserted in and bridged over the terminal receptacle of the socket main body, a top end of a first leg of the U-shaped section being bent to form a horizontal connecting section for connecting with another circuit board, a resilient section being integrally connected with a second leg of the U-shaped section, a contact section upright integrally extending from a rear end of the resilient section, whereby when the socket main body is correspondingly inserted into the insertion channel of the base seat main body, the second leg of the U-shaped section of the first type terminal resiliently abuts against the first leg of the U-shaped section of the second type terminal to form a first electric contact and the contact pin of the rear end of the first type terminal resiliently contacts with the contact section of the rear end of the second type terminal to form a second electric contact.

The present invention can be best understood through the following description and accompanying drawings wherein:

DETAILED DESCRIPTION OF THE PREFERRED EMBODIMENTS

Please refer to FIGS. 3 to 9. The multiple-contact micron connector of the present invention includes a base seat main body 1, a socket main body 2, multiple first type terminals 3 and multiple second type terminals 4. The first type terminals 3 are parallelly inserted in two sides of the base seat main body 1. The second type terminals 4 are parallelly inserted in two sides of the socket main body 2. When the socket main body 2 is correspondingly inserted in the base seat main body 1, the first type terminals 3 multiple-contact resiliently contact with the second type terminals 4 to enhance the stability of telecommunication.

Figure 1:
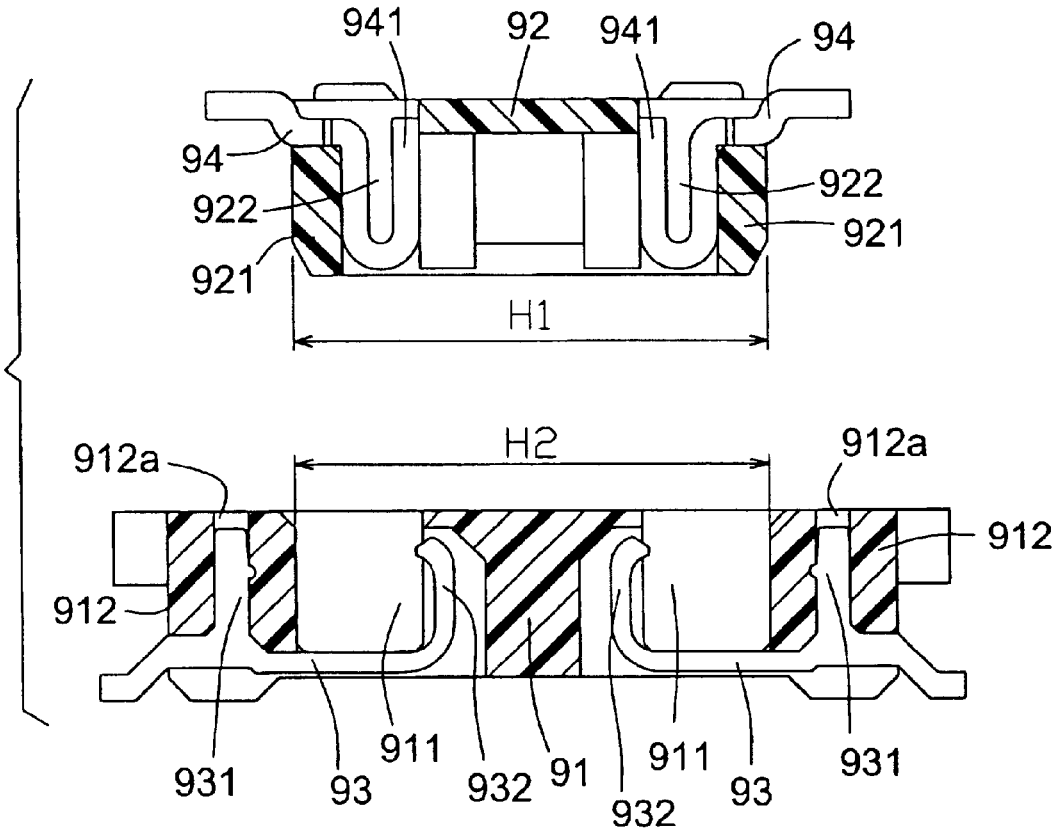
Fig. 1 PRIOR ART
FIG. 1 is a sectional exploded view of a conventional micron connector.
Figure 2:
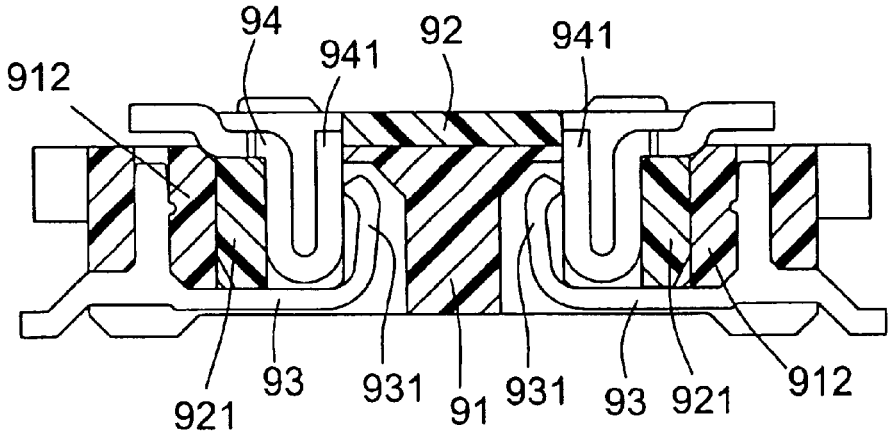
Fig. 2 PRIOR ART
FIG. 2 is a sectional assembled view of the conventional micron connector.
Figure 3:
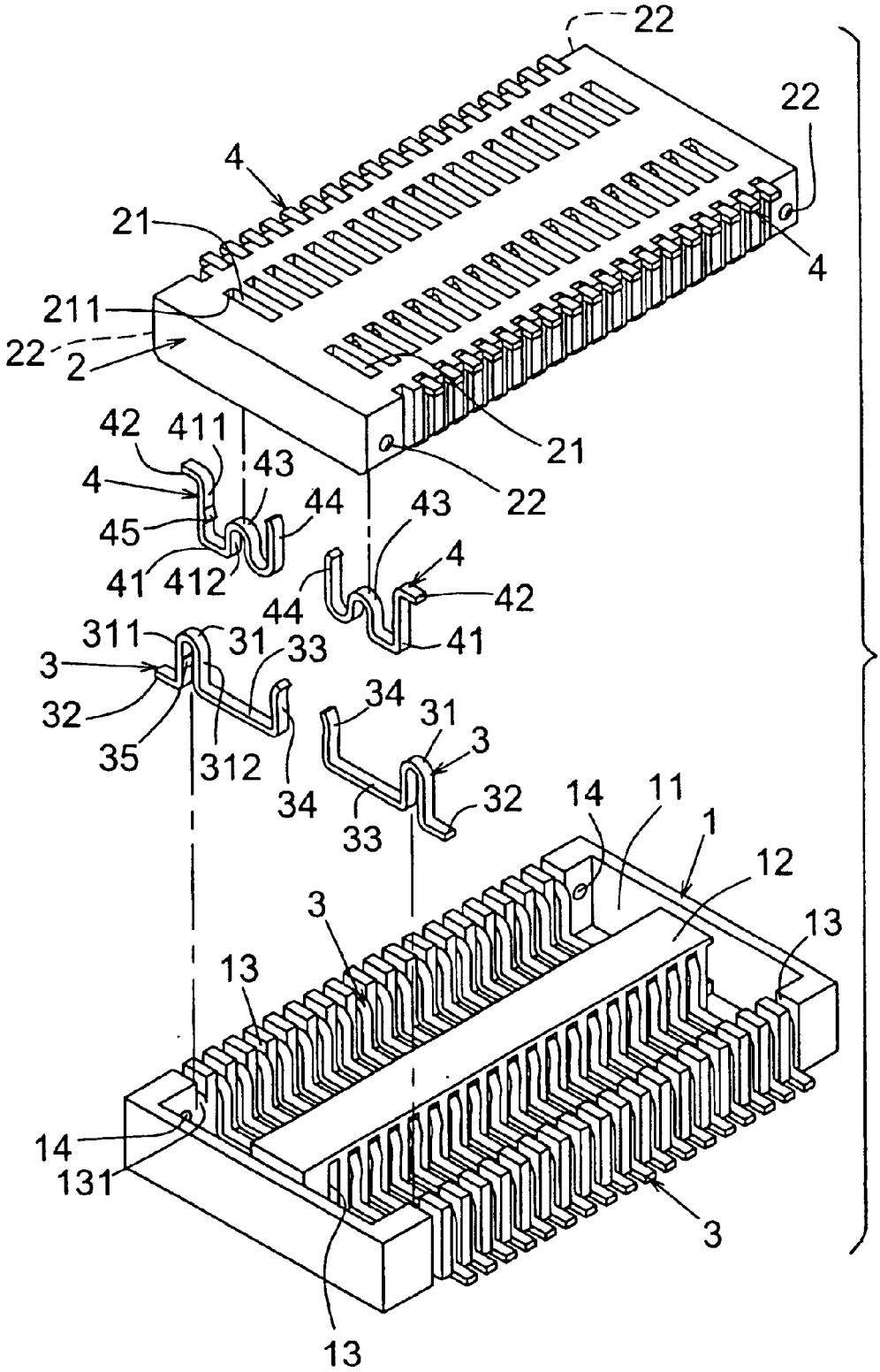
FIG. 3 is a perspective exploded view of the present invention.
Figure 4:
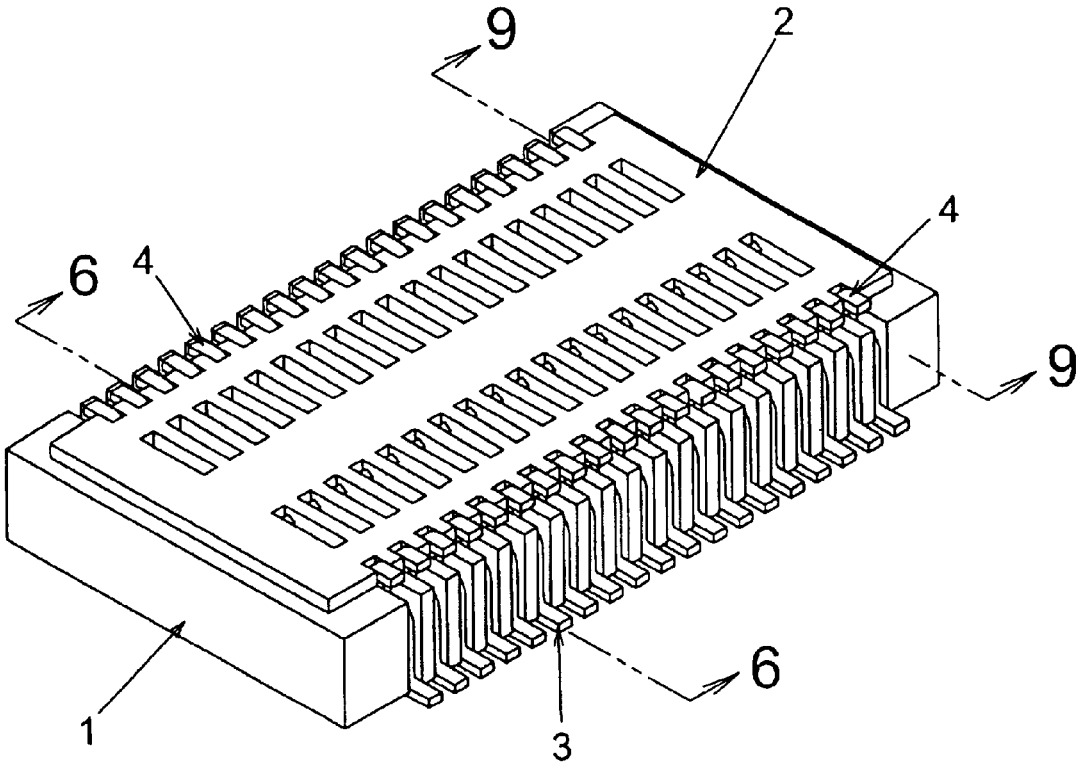
FIG. 4 is a perspective assembled view of the present invention.
Figure 5:
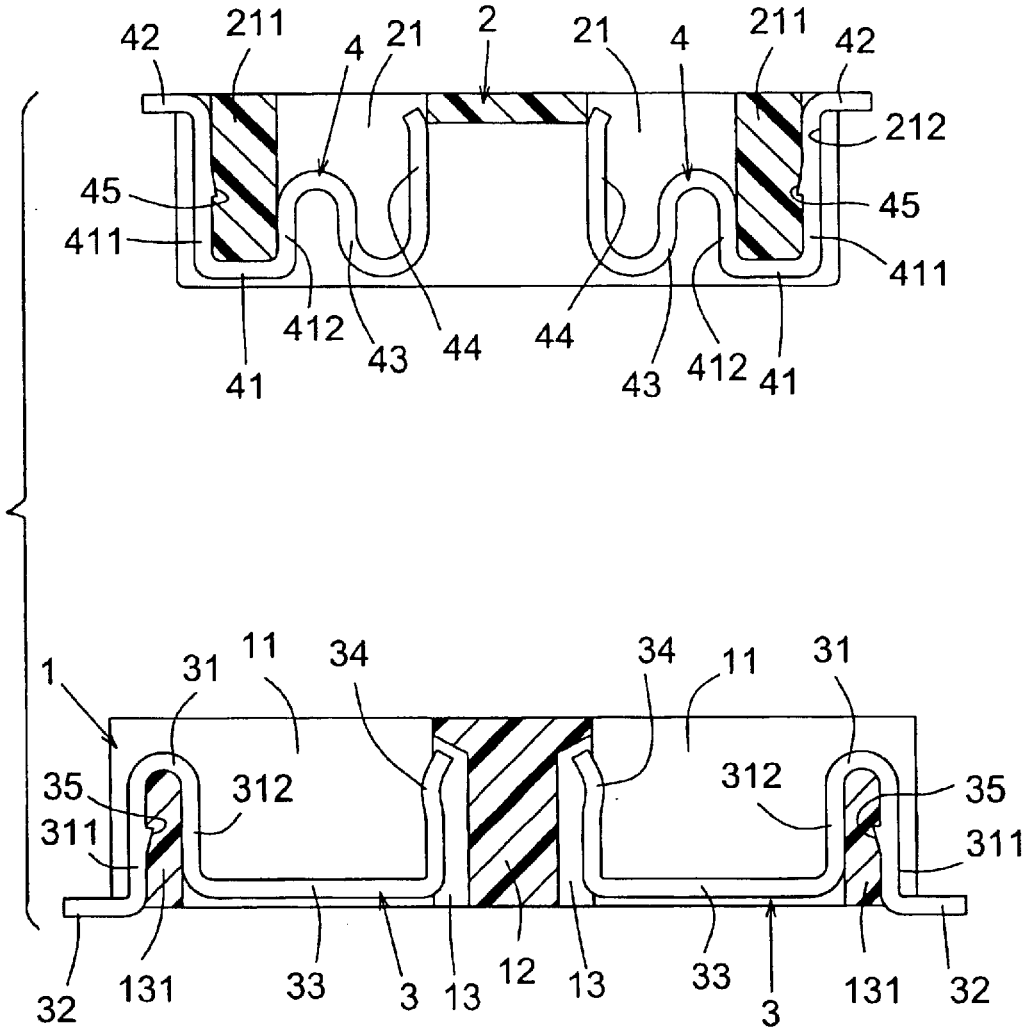
FIG. 5 is a sectional exploded view of the present invention.

Referring to FIGS. 3, 4 and 5, the base seat main body 1 is made of insulating material. A longitudinal insertion channel 11 is formed on upper end face of the base seat main body 1. A central partitioning board 12 is disposed at the center of the insertion channel 11. Two sides of the partitioning board 12 are respectively parallelly formed with multiple terminal receptacles 13. A support board 131 is disposed on outer side of each terminal receptacle 13. A U-shaped section 31 of the first type terminal 3 is bridged over the support board 131.

At least one latch projection 14 is formed on the wall face of the insertion channel 11 of the base seat main body 1. At least one locating projection 22 is formed on outer edge of the socket main body 2. The latch projection 14 can be correspondingly latched with the locating projection 22 to firmly engage the socket main body 2 in the base seat main body 1.

The socket main body 2 is made of insulating material. Two sides of the socket main body 2 are parallelly formed with multiple terminal receptacles 21. The socket main body 2 can be correspondingly inserted in the insertion channel 11 of the base seat main body 1. A support block 211 is disposed on outer side of each terminal receptacle 21. A U-shaped section 41 of the second type terminal 4 is correspondingly bridged over the support block 211, whereby the second type terminal 4 can be firmly inlaid in the terminal receptacle 21 of the socket main body 2.

Figure 7:
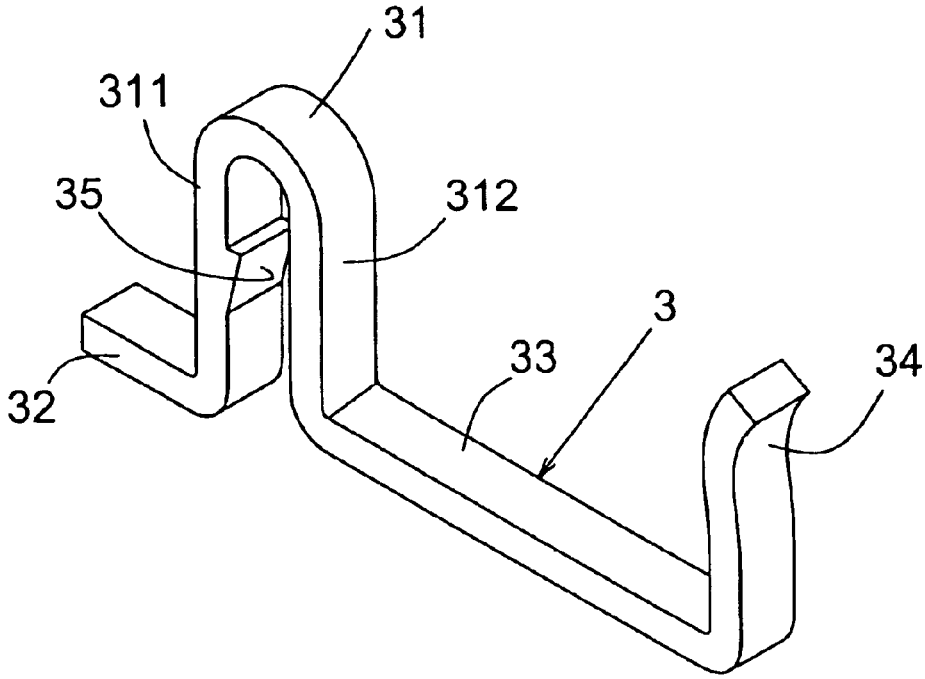
FIG. 7 is a perspective view of the first type terminal of the present invention.

Referring to FIGS. 5 and 7, the first type terminal 3 has a U-shaped section 31 which can be correspondingly bridged over the support board 131 on outer side of the terminal receptacle 13 of the base seat main body 1. A rear end of a first leg 311 of the U-shaped section 31 is radially bent to form a connecting pin 32 for connecting with a circuit board (not shown). A resilient arm 33 extends from a rear end of a second leg 312 of the U-shaped section 31. A contact pin 34 upward extends from the rear end of the resilient arm 33. The contact pin 34 is adjacent to the central partitioning board 12 of the base seat main body 1.

At least one reverse thorn 35 projects from the first leg 311 of the U-shaped section 31 of the first type terminal 3 for correspondingly latching the first type terminal 3 in the terminal receptacle 13 of the base seat main body 1.

Figure 8:
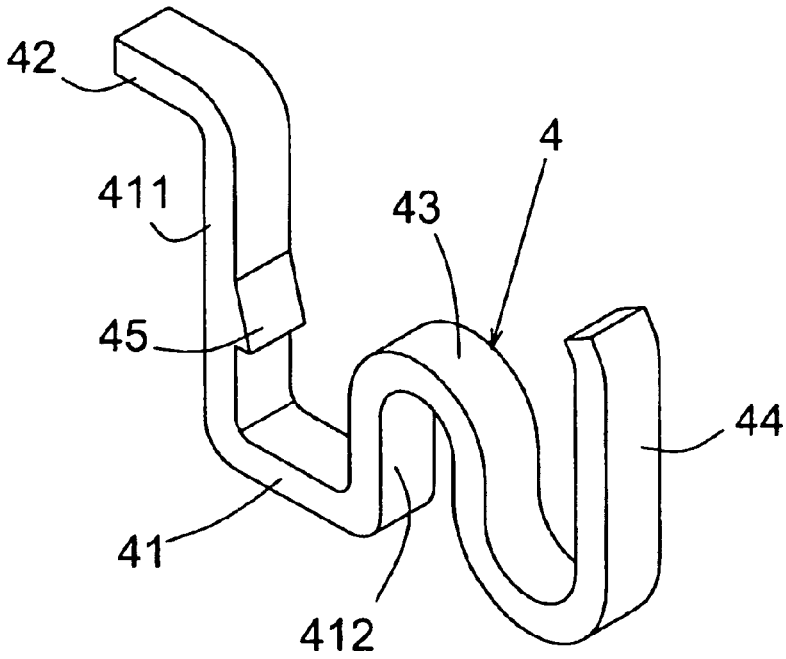
FIG. 8 is a perspective view of the second type terminal of the present invention.
Figure 9:
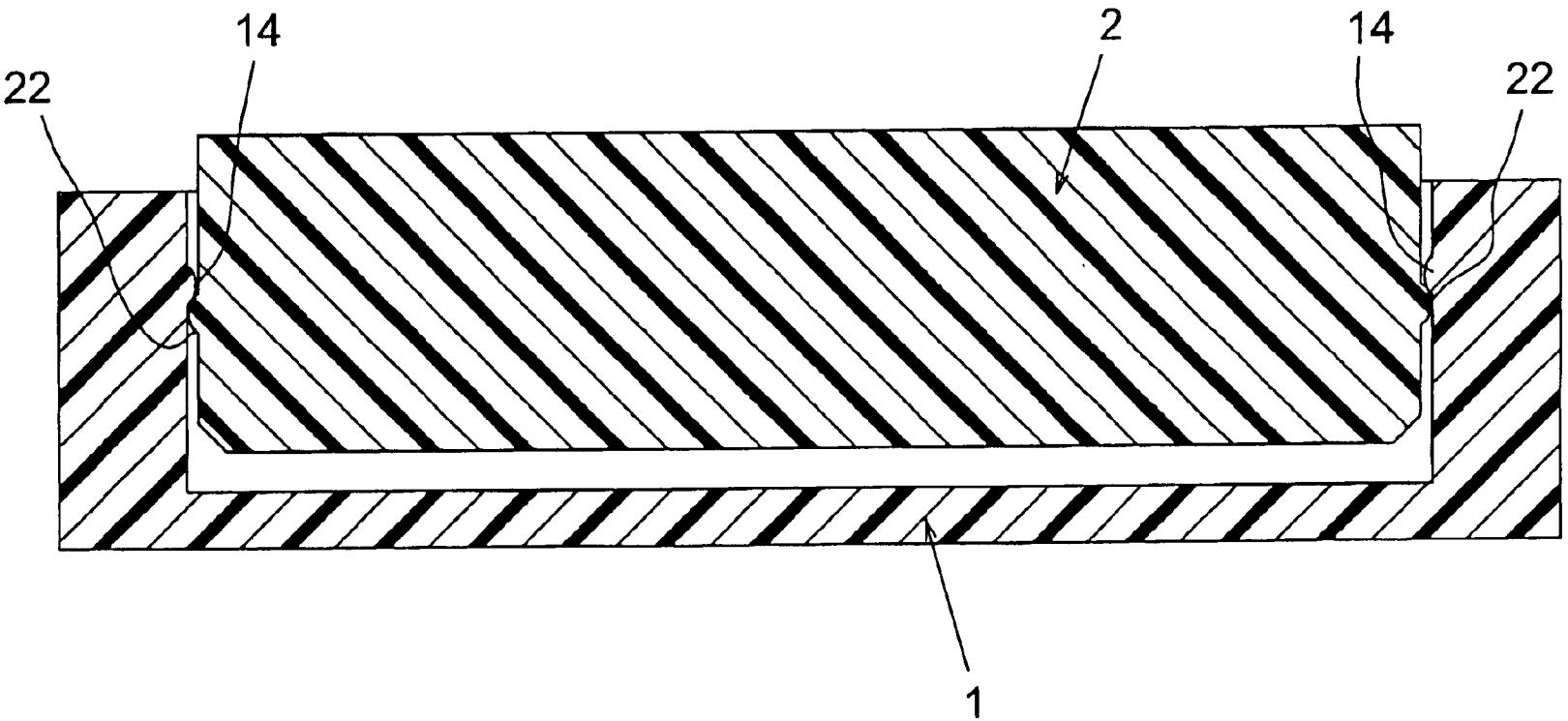
FIG. 9 is a sectional view taken along line 9—9 of FIG. 4.

Referring to FIGS. 5 and 8, the second type terminal 4 has a U-shaped section 41 which can be bridged over the support block 211 on outer side of the terminal receptacle 21 of the socket main body 2. A top end of a first leg 411 of the U-shaped section 41 is bent to form a horizontal connecting section 42 for connecting with another circuit board (not shown). A resilient section 43 is integrally connected with a second leg 412 of the U-shaped section 41. A contact section 44 upright integrally extends from the rear end of the resilient section 43.

The contact section 43 of the second type terminal 4 can be U-shaped or S-shaped. This is not limited. At least one reverse thorn 45 projects from the first leg 411 of the U-shaped section 41 of the second type terminal 4 for correspondingly latching the second type terminal 4 in the terminal receptacle 21 of the socket main body 2.

Figure 6:
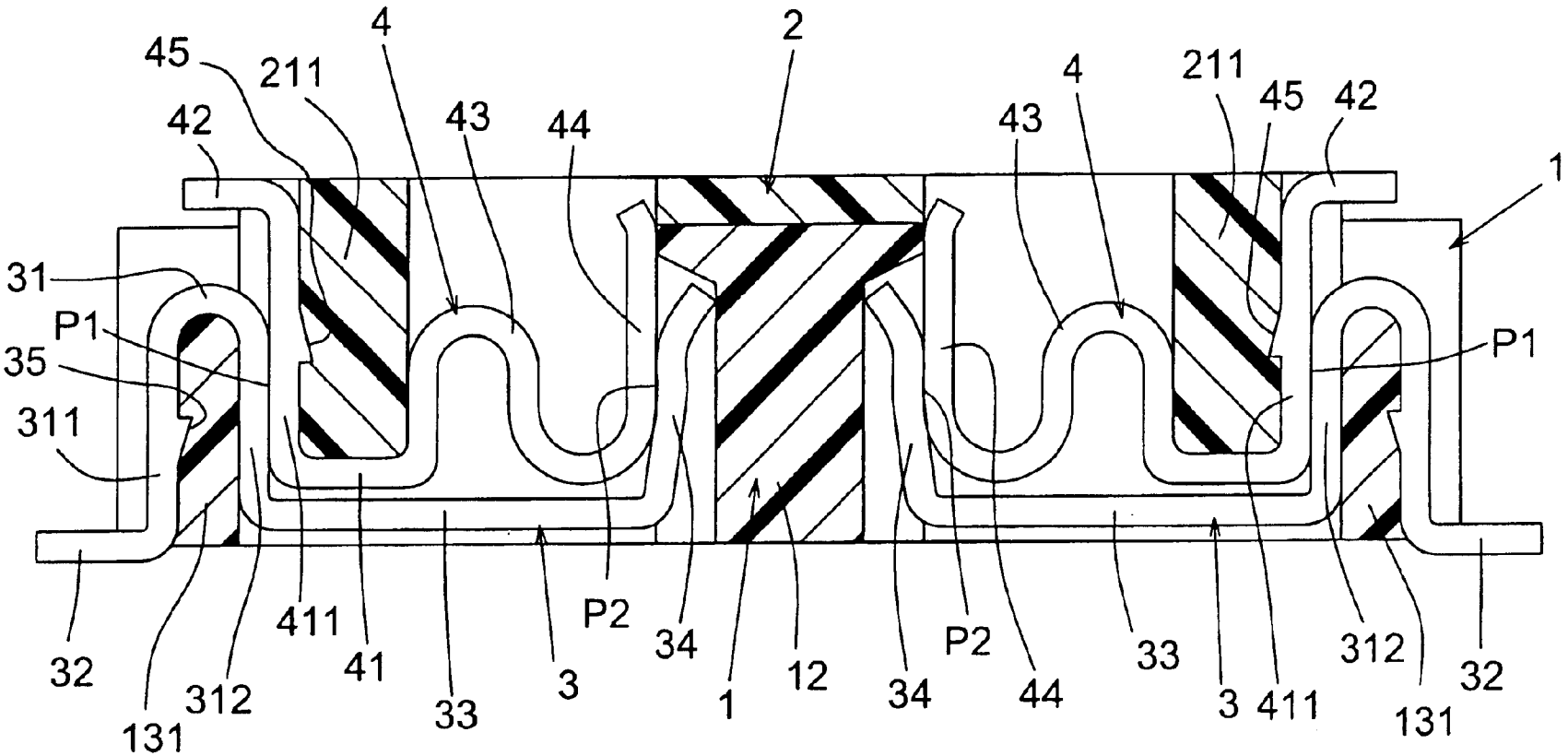
FIG. 6 is a sectional view taken along line 6—6 of FIG. 4.

Referring to FIG. 5, when the base seat main body 1 is separated from the socket main body 2, the second leg of the U-shaped section 31 of the first type terminal 3 inserted in the base seat main body 1 is a free section which can be resiliently biased. Accordingly, as shown in FIG. 6, when the socket main body 2 is correspondingly inserted into the insertion channel 11 of the base seat main body 1, the inner side of the first leg 411 of the U-shaped section 41 of the second type terminal 4 inserted in the socket main body 2 is stopped by the support block 211 so that the second leg 312 of the U-shaped section 31 of the first type terminal 3 can resiliently tightly abut against the outer side of the first leg 411 of the U-shaped section 41 of the second type terminal 4 to form a first electric contact P1. The contact section 44 of the rear end of the second type terminal 4 resiliently contacts with the contact pin 34 of the rear end of the first type terminal 3 to form a second electric contact P2.

In the multiple-contact micron connector of the present invention, the second leg 312 of the U-shaped section 31 and the contact pin 34 of the first type terminal 3 resiliently clamp two sides of the second type terminal 4 (that is, the first leg 411 of the U-shaped section 41 and the contact section 44 of the second type terminal 4). The first type and second type terminals 3, 4 are made of metal plate by punching and will not contract. Therefore, in manufacturing, the sizes of the first type and second type terminals 3, 4 can be very precise. Accordingly, without being affected by the contraction of the plastic material, the first type and second type terminals 3, 4 can achieve stable multiple-contact effect as designed. Therefore, the ratio of defective products is lowered.

The present invention is characterized in that the first type terminal 3 resiliently tightly clamps two sides of the second type terminal 4 to form the multiple-contact connector. In contrast, in the conventional micron connector, only one side of the first type terminal resiliently leans against the second type terminal to achieve single electric contact. Apparently, the present invention is advantageous over the conventional micron connector.

The above embodiments are only used to illustrate the present invention, not intended to limit the scope thereof. Many modifications of the above embodiments can be made without departing from the spirit of the present invention.

What is claimed is:

1. A multiple-contact micron connector comprising:

(a) a base seat main body, a longitudinal insertion channel being formed on upper end face of the base seat main body, a central partitioning board being disposed at a center of the insertion channel, two sides of the partitioning board being respectively parallelly formed with multiple terminal receptacles;

(b) a socket main body, two sides of the socket main body being parallelly formed with multiple terminal receptacles, whereby the socket main body can be correspondingly inserted in the insertion channel of the base seat main body;

(c) multiple first type terminals respectively inserted in the terminal receptacles of the base seat main body, each first type terminal having a U-shaped section bridged over a support board on outer side of the terminal receptacle, a rear end of a first leg of the U-shaped section being radially bent to form a connecting pin for connecting with a circuit board, a resilient arm extending from a rear end of a second leg of the U-shaped section, a contact pin upward extending from a rear end of the resilient arm; and (d) multiple second type terminals each having a U-shaped section inserted in and bridged over the terminal receptacle of the socket main body, a top end of a first leg of the U-shaped section being bent to form a horizontal connecting section for connecting with another circuit board, a resilient section being integrally connected with a second leg of the U-shaped section, a contact section upright integrally extending from a rear end of the resilient section, whereby when the socket main body is correspondingly inserted into the insertion channel of the base seat main body, the second leg of the U-shaped section of the first type terminal resiliently abuts against the first leg of the U-shaped section of the second type terminal to form a first electric contact and the contact pin of the rear end of the first type terminal resiliently contacts with the contact section of the rear end of the second type terminal to form a second electric contact.

2. The multiple-contact micron connector as claimed in claim 1, wherein a support board is disposed on outer side of each terminal receptacle of the base seat main body, the U-shaped section of the first type terminal being correspondingly bridged over the support board.

3. The multiple-contact micron connector as claimed in claim 1, wherein at least one reverse thorn projects from the first leg of the U-shaped section of the first type terminal for correspondingly latching the first type terminal in the terminal receptacle of the base seat main body.

4. The multiple-contact micron connector as claimed in claim 1, wherein a support block is disposed on outer side of each terminal receptacle of the socket main body, the U-shaped section of the second type terminal being correspondingly bridged over the support block.

5. The multiple-contact micron connector as claimed in claim 1, wherein at least one reverse thorn projects from the first leg of the U-shaped section of the second type terminal for correspondingly latching the second type terminal in the terminal receptacle of the socket main body.

6. The multiple-contact micron connector as claimed in claim 1, wherein the resilient section of the second type terminal is U-shaped.

7. The multiple-contact micron connector as claimed in claim 1, wherein the resilient section of the second type terminal is S-shaped.

8. The multiple-contact micron connector as claimed in claim 1, wherein at least one latch projection is formed on a wall face of the insertion channel of the base seat main body and at least one locating projection is formed on outer edge of the socket main body, whereby the latch projection can be correspondingly latched with the locating projection to firmly engage the socket main body in the base seat main body.

* * * * *